US007815556B1

(12) United States Patent
Bauer

(10) Patent No.: US 7,815,556 B1
(45) Date of Patent: Oct. 19, 2010

(54) MODULAR EXERCISE APPARATUS

(76) Inventor: Jeremy J. Bauer, 762 W. Canterbury Rd., Apartment C, St. Louis, MO (US) 63132

( * ) Notice: Subject to any disclaimer, the term of this patent is extended or adjusted under 35 U.S.C. 154(b) by 128 days.

(21) Appl. No.: 12/391,876

(22) Filed: Feb. 24, 2009

(51) Int. Cl.
*A63B 21/04* (2006.01)
*A63B 21/02* (2006.01)

(52) U.S. Cl. ..... 482/129; 482/121

(58) Field of Classification Search ..... 482/16, 482/92, 121, 126, 129, 907, 908, 910; D21/662, D21/673, 686, 692; 248/127, 519, 165–166, 248/150, 174, 164, 528, 346.01, 346.3; 211/189, 211/195–6, 198–9, 204–206
See application file for complete search history.

(56) References Cited

U.S. PATENT DOCUMENTS 1,357,041 A * 10/1920 Fritch ..... 211/69
1,711,922 A * 5/1929 Curtis ..... 211/69
4,029,211 A * 6/1977 Marshall ..... 211/104
4,538,804 A 9/1985 Zibell
4,749,184 A * 6/1988 Tobin ..... 482/87
D315,935 S 4/1991 Wilson et al.
5,013,035 A * 5/1991 Nathaniel ..... 482/129
5,320,591 A 6/1994 Harmon et al.
5,536,228 A * 7/1996 Tanner, Jr. ..... 482/130
5,586,962 A * 12/1996 Hallmark ..... 482/129
5,601,518 A 2/1997 Weintraub
5,613,658 A * 3/1997 Rogelja ..... 248/163.1
5,626,546 A * 5/1997 Little ..... 482/129
5,662,564 A 9/1997 Nelson
5,913,749 A * 6/1999 Harmon ..... 482/49
5,967,093 A * 10/1999 Vitt et al. ..... 119/705
6,120,421 A * 9/2000 Kuo ..... 482/111
6,267,711 B1 * 7/2001 Hinds ..... 482/121
6,612,170 B2 9/2003 Brown
6,612,845 B1 * 9/2003 Macri et al. ..... 434/247
6,634,998 B2 * 10/2003 Siaperas ..... 482/142
7,077,277 B2 * 7/2006 Wang ..... 211/206
7,137,937 B2 11/2006 Croft
7,410,450 B1 * 8/2008 Paulding ..... 482/121
2002/0160891 A1 10/2002 Gallagher
2006/0160681 A1 * 7/2006 McBride et al. ..... 482/123
2006/0194680 A1 8/2006 Croft
2008/0214369 A1 * 9/2008 Mancini ..... 482/121

* cited by examiner

*Primary Examiner*—Nicholas D Lucchesi
*Assistant Examiner*—Sundhara M Ganesan
(74) *Attorney, Agent, or Firm*—Crossley Patent Law; Mark A. Crossley

(57) ABSTRACT

The modular exercise apparatus has a semicircular modular base with a first swingarm selectively affixed to the second swingarm, a first arc selectively affixed to the first swingarm, a second arc selectively affixed to the second swingarm, a plurality of vertically disposed spaced apart arc orifices disposed on the arcs, a center vertical selectively inserted into the selectively affixed first swingarm and second swingarm, a plurality of spaced apart center vertical orifices disposed along the center vertical, a pair of identical verticals, the verticals selectively inserted into any one of the plurality of arc orifices, at least one elastic cable having a pair of identical spaced apart removable handles comprising a first handle and a second handle, each cable selectively passed through one or more of the center vertical orifices and through one or more of the vertical orifices of the verticals.

15 Claims, 5 Drawing Sheets

70
80
72

50
22
24
20
36
36
36
36
30
40

MODULAR EXERCISE APPARATUS

BACKGROUND OF THE INVENTION

A plethora of exercise devices have been presented over the past many years. Of those, many have been multi-exercise devices whereby a user might perform a variety of exercises on one device. Still further qualification exists in differentiation between multi-exercise devices which use added mass for resistance versus those which use elastic cables. For obvious reasons of mass and portability, elastic cables have a definite following among users. The present exercise apparatus provides a modular, free-standing apparatus which provides a variety of exercise positions and resistance variation which has not heretofore existed, with elastic cables.

FIELD OF THE INVENTION

The modular exercise apparatus relates to multi-exercise devices and more especially to a free-standing modular multi-exercise device which employs elastic cables.

SUMMARY OF THE INVENTION

The general purpose of the modular exercise apparatus, described subsequently in greater detail, is to provide a modular exercise apparatus which has many novel features that result in an improved modular exercise apparatus which is not anticipated, rendered obvious, suggested, or even implied by prior art, either alone or in combination thereof.

To attain this, the modular exercise apparatus can easily be assembled and disassembled, providing excellent mobility. No tools or equipment are needed in assembly or disassembly. The apparatus is free-standing, not requiring any anchors or the use of other devices or objects in order to function. Metals and high grade plastics and other synthetics are chosen throughout the apparatus construction to provide optimal strength and light weight. The base is assembled either with or without the base insert. The three verticals are used as chosen with insertion of elastic cables as desired.

The optional collars further provide for a multitude of positions and cable insertions, which can either include or exclude the use of the open loops and the rings.

The optional base insert crossbar loops also provide for selective cable insertion. A user can therefore design any of a myriad of exercises for lifting, pulling, stretching, or any other imaginable effort against elastic cable resistance.

The optional semicircular sleeve provides added advantage to the center vertical and to elastic cable insertion.

Thus has been broadly outlined the more important features of the improved modular exercise apparatus so that the detailed description thereof that follows may be better understood and in order that the present contribution to the art may be better appreciated.

An object of the modular exercise apparatus is to provide easy assembly and disassembly.

Another object of the modular exercise apparatus is to provide a great variety of exercise possibilities for a user.

A further object of the modular exercise apparatus is to employ elastic cables for resistance.

An added object of the modular exercise apparatus is to be relatively compact considering the great variety of exercise possibilities.

And, an object of the modular exercise apparatus is to be free-standing.

These together with additional objects, features and advantages of the improved modular exercise apparatus will be readily apparent to those of ordinary skill in the art upon reading the following detailed description of presently preferred, but nonetheless illustrative, embodiments of the improved modular exercise apparatus when taken in conjunction with the accompanying drawings.

In this respect, before explaining the current embodiments of the improved modular exercise apparatus in detail, it is to be understood that the modular exercise apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved modular exercise apparatus. It is therefore important that the claims be regarded as including such equivalent constructions insofar as they do not depart from the spirit and scope of the modular exercise apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 5 thereof, the principles and concepts of the modular exercise apparatus generally designated by the reference number 10 will be described.

Figure 1:
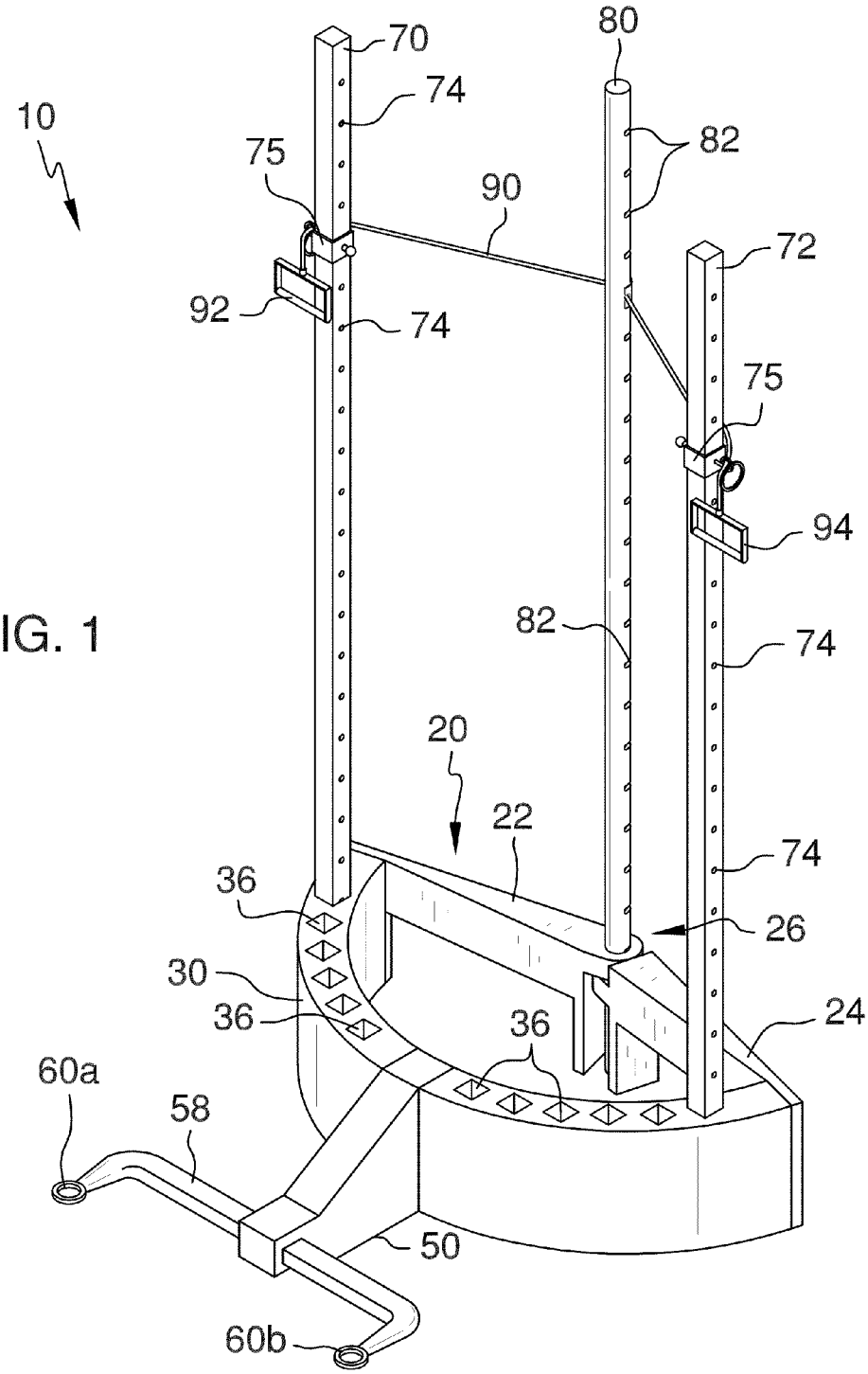
FIG. 1 is a perspective view.

Referring to FIG. 1, the modular exercise apparatus 10 provides selectively disposed resistance, via the elastic cable 90 and cable 90 positioning within the apparatus 10. The cable 90 with removable handles comprises the first handle 92 and the second handle 94. The cable 90 is selectively passed through any chosen vertical orifice 74 of either, neither, or both of the verticals comprised of the first vertical 70 and the second vertical 72. The cable 90 is also selectively passed through any of the center vertical orifices 82 of the center vertical 80. The cable 90 is also selectively passed through one or more of the rings 78. The cable 90 is also selectively passed through one or more of the open loops 77 of the collars 75. The cable 90 is also selectively passed through one or more of the crossbar 58 loops comprised of the first crossbar loop 60*a* and the second crossbar loop 60*b*. Additionally, either vertical is selectively positioned within any chosen arc orifice 36. The myriad of potential cable 90 routes enables a user a chosen resistance to virtually any human movement, thereby exercising the chosen body part or body parts. The apparatus 10 is not limited to one cable 90 or cable 90 length. Handles accommodate both hands and feet of a user, thereby further enabling exercise choices.

Figure 2:
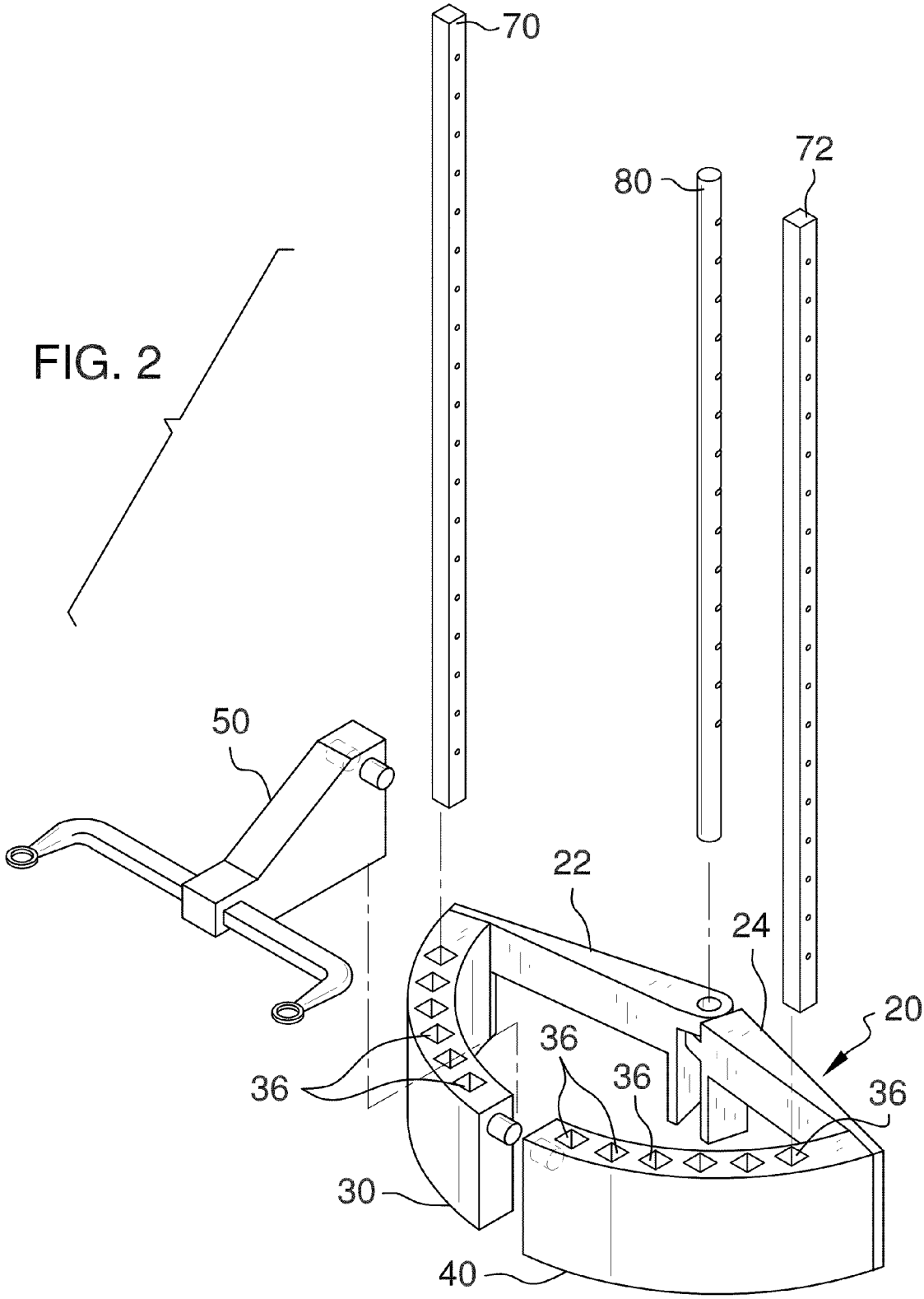
FIG. 2 is a partially exploded perspective view of the base and verticals.
Figure 4:
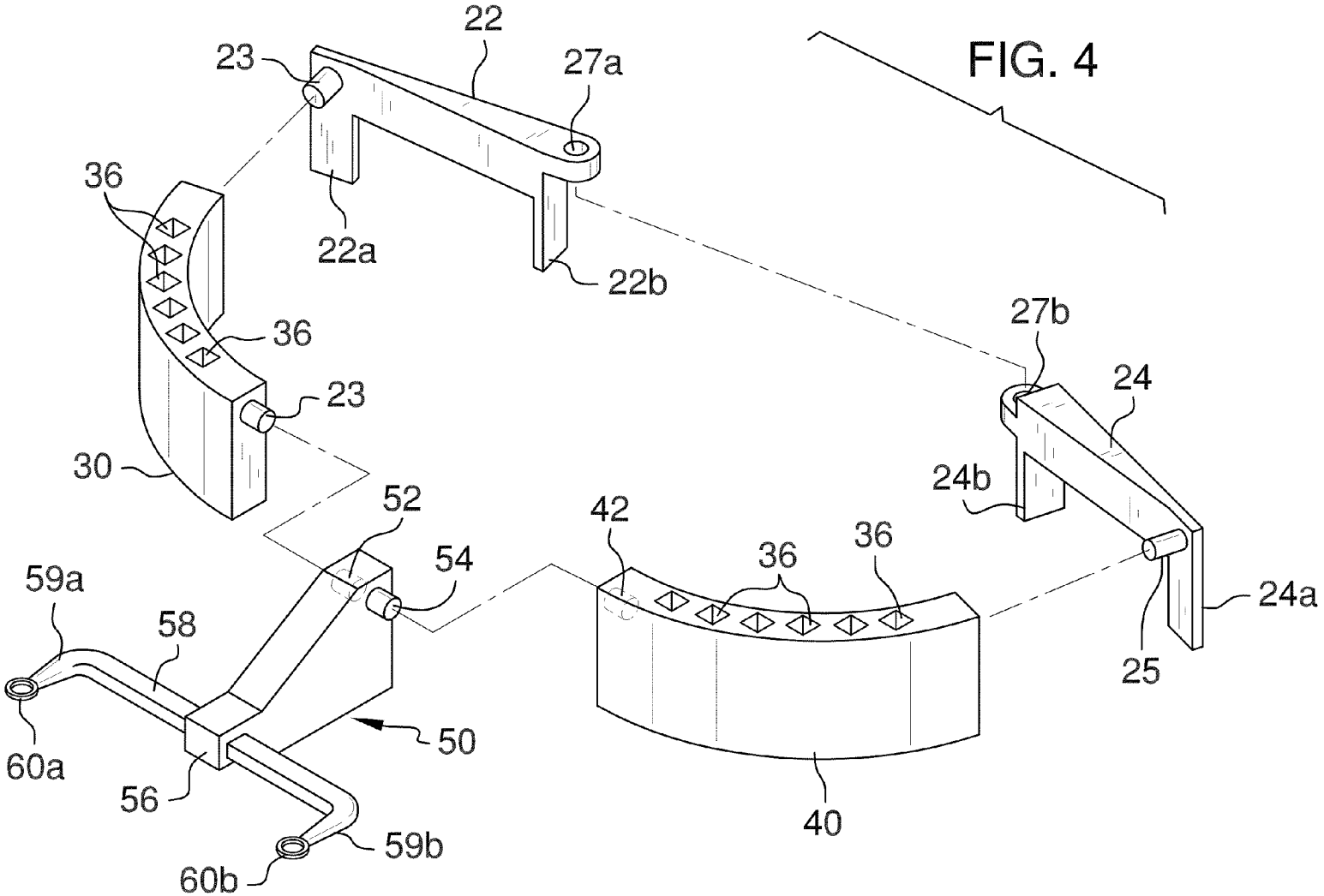
FIG. 4 is a perspective view of the disassembled base.

Referring to FIGS. 2 and 4, the apparatus 10 partially comprises the semicircular base 20 with modular assembly and disassembly, as chosen. The base 20 comprises the first swingarm 22 having a first swingarm outer leg 22*a* and a first swingarm inner leg 22*b*. The first swingarm 22 first joint port 27*a* is medially adjacent to the first swingarm inner leg 22*b*. The first swingarm peg 23 is laterally disposed, perpendicularly to the first swingarm outer leg 22*a*. The base 20 further comprises the second swingarm 24 having a second swingarm outer leg 24*a* and a second swingarm inner leg 24*b*. The second joint port 27*b* is disposed medially, adjacent to the second swingarm inner leg 24*b*. The second swingarm peg 25 is laterally disposed, perpendicularly to the second swingarm outer leg 24*a*. The apparatus 10 base 20 also comprises the first arc 30 which is selectively affixed to the first swingarm 22. The first arc 30 comprises a plurality of vertically disposed spaced apart arc orifices 36.

Figure 5:
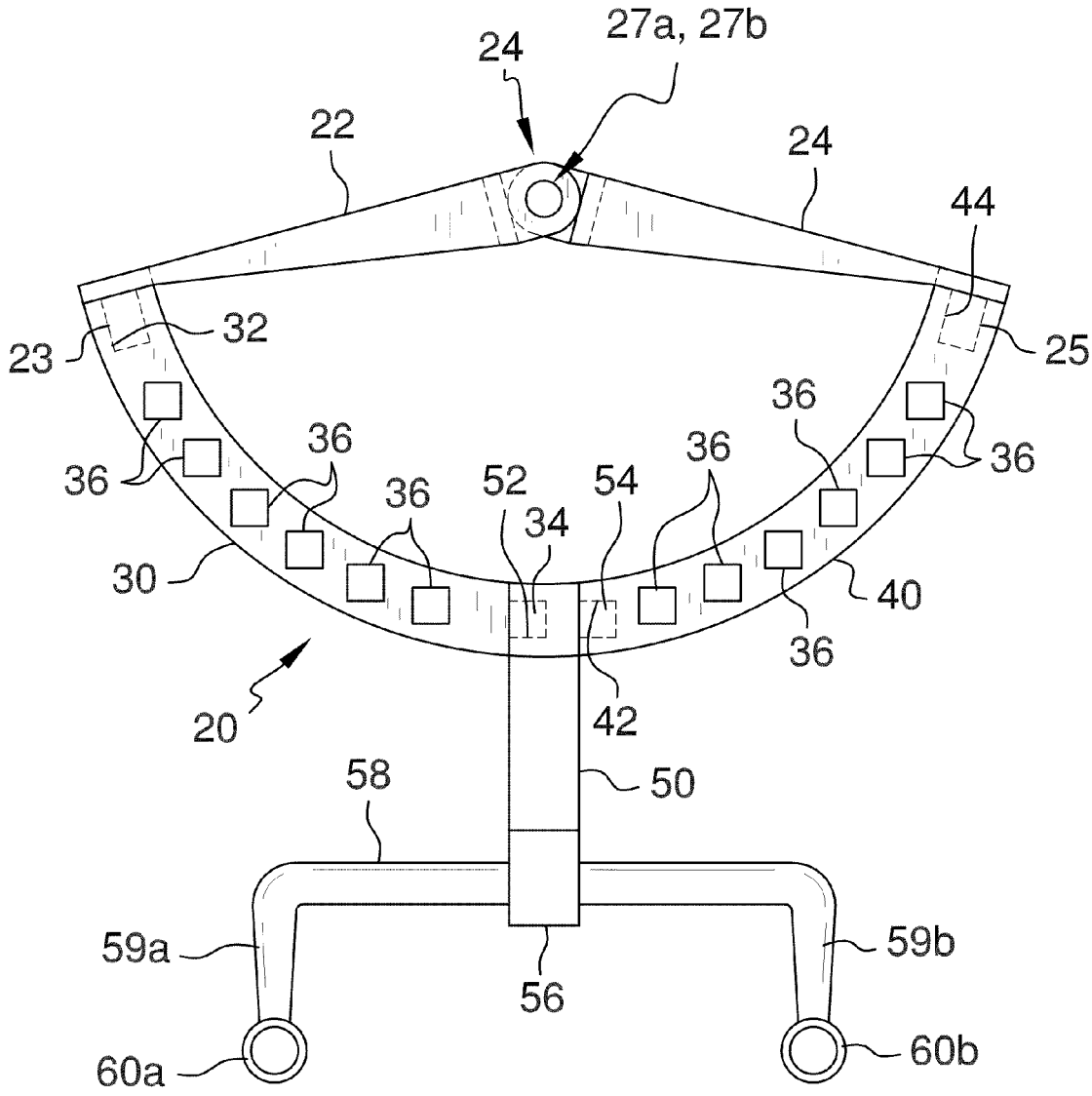
FIG. 5 is a top plan view of the assembled base with base insert.

Continuing to refer to FIGS. 2 and 4 and further referring to FIG. 5, the horizontally disposed first arc port 32 selectively receives the first swingarm peg 23. The horizontally disposed first arc peg 34 is spaced apart from the first arc port 32. The second arc 40 is selectively affixed to the first arc 30. The second arc 40 comprises a plurality of vertically disposed spaced apart arc orifices 36. The horizontally disposed second arc first port 42 selectively receives the first arc peg 34. The second arc second port 44 is spaced apart from the second arc first port 42. The second arc second port 44 selectively receives the second swingarm peg 25. The base 20 further comprises the base insert 50. The base insert 50 is selectively positioned between the first arc 30 and the second arc 40. The base insert 50 comprises a base insert port 52 spaced apart from a base insert peg 54. The base insert port 52 selectively receives the first arc peg 34. The base insert peg 54 is selectively inserted into the second arc first port 42. The base insert 50 further comprises the base insert extension 56 which is spaced apart from the base insert port 52 and the base insert peg 54. The crossbar 58 is affixed perpendicularly through the base insert extension 56. The pair of spaced apart right angles is disposed on the crossbar 58 and comprises the first right angle 59*a* and the second right angle 59*b*. Each right angle has a crossbar loop comprising a first crossbar loop 60*a* and a second crossbar loop 60*b*.

Referring to FIG. 2 and again to FIG. 4, the center vertical 80 is selectively inserted into the first joint port 27*a* and the second joint port 27*b*. The first joint port 27*a*, the second joint port 27*b*, and the center vertical 80 form the pivot joint 26 whereby the swingarms are positioned as chosen.

Figure 3:
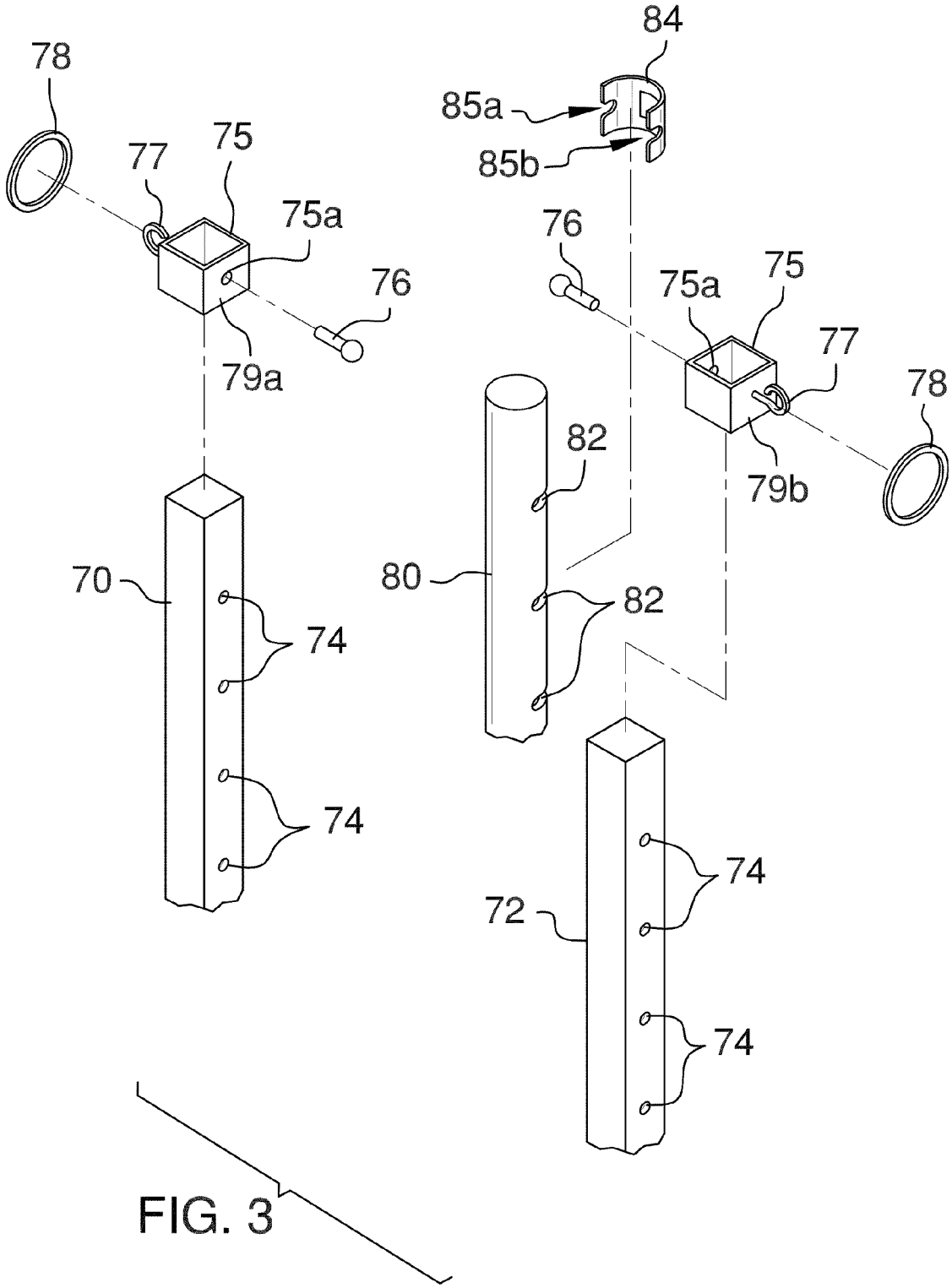
FIG. 3 is a partial perspective view of the first and second verticals, the center vertical, and related features.

Referring to FIG. 3, the plurality of spaced apart center vertical orifices 82 is disposed along the center vertical 80. The semicircular sleeve 84 is selectively positioned along the center vertical 80. The sleeve 84 partially comprises a pair of opposed notches comprised of the first notch 85*a* and the second notch 85*b*. The notches are selectively positioned in alignment with one of the plurality of center vertical orifices 82. The first vertical 70 is selectively inserted into any one of the plurality of first arc 30 arc orifices 36. The second vertical 72 is selectively inserted into any one of the plurality of second arc 40 arc orifices 36. Each vertical further comprises a plurality of spaced apart horizontally disposed vertical orifices 74. The pair of identical collars 75 is provided. The apparatus is not limited to only two collars 75. Each collar 75 is selectively and slideably fitted over each of the pair of identical verticals. Each collar has a collar first side 79*a* spaced apart from a collar second side 79*b*. Each collar further comprises a horizontally disposed collar orifice 75*a* within the collar first side 79*a*. A keeper 76 is selectively inserted into the collar orifice 75*a* and into one of the selected vertical orifices 74 of one of the verticals. An open loop 77 is disposed on each collar second side 79*b*. At least a pair of identical rings 78 is provided. The apparatus 10 is therefore not limited to two rings 78 only. Each ring 78 is selectively disposed on one of the open loops 77 of one of the collars 75.

With respect to the above description then, it is to be realized that the optimum dimensional relationships for the parts of the modular exercise apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the modular exercise apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the modular exercise apparatus may be used.

Therefore, the foregoing is considered as illustrative only of the principles of the modular exercise apparatus. Further, since numerous modifications and changes will readily occur to those skilled in the art, it is not desired to limit the modular exercise apparatus to the exact construction and operation shown and described, and accordingly, all suitable modifications and equivalents may be resorted to, falling within the scope of the modular exercise apparatus.

What is claimed is:

1. A modular exercise apparatus, comprising, in combination:

a semicircular multi-part base providing selective assembly, the base further comprising:

a first swingarm;

a second swingarm selectively affixed to the first swingarm;

a first arc selectively affixed to the first swingarm;

a plurality of vertically disposed spaced apart arc orifices disposed on the first arc;

a second arc selectively affixed to the first arc, the second arc selectively affixed to the second swingarm;

a plurality of vertically disposed spaced apart arc orifices disposed on the second arc;

a center vertical selectively inserted into the selectively affixed first swingarm and second swingarm;

a plurality of spaced apart center vertical orifices disposed along the center vertical;

a pair of identical verticals comprising a first vertical and a second vertical, the first vertical selectively inserted into any one of the plurality of first arc arc orifices, the second vertical selectively inserted into any one of the plurality of second arc arc orifices;

at least one elastic cable having a pair of identical spaced apart removable handles comprising a first handle and a second handle, each cable selectively passed through one or more of the center vertical orifices, each cable further selectively passed through one or more of the vertical orifices of the verticals.

2. The apparatus according to claim 1 wherein second swingarm selectively affixed to the first swingarm further comprises a pivot.

3. The apparatus according to claim 2 wherein the pivot further comprises a pivot joint, the pivot joint further comprising a first joint port disposed medially on the first swingarm, a second joint port disposed medially on the second swingarm, the first joint port, the second joint port, and the center vertical forming the pivot joint.

4. The apparatus according to claim 1 wherein the first arc selectively affixed to the first swingarm further comprises an assembly via a peg and a port;

the second arc selectively affixed to the second swingarm further comprises an assembly via a peg and a port.

5. The apparatus according to claim 2 wherein the first arc selectively affixed to the first swingarm further comprises an assembly via a peg and a port;

the second arc selectively affixed to the second swingarm further comprises an assembly via a peg and a port.

6. The apparatus according to claim 3 wherein the first arc selectively affixed to the first swingarm further comprises an assembly via a peg and a port;

the second arc selectively affixed to the second swingarm further comprises an assembly via a peg and a port.

7. A modular exercise apparatus, comprising, in combination:

a semicircular multi-part base providing selective assembly, the base further comprising:

a first swingarm;

a first joint port disposed medially on the first swingarm;

a second swingarm;

a second joint port disposed medially on the second swingarm;

a first arc selectively affixed to the first swingarm via a peg and a port;

a plurality of vertically disposed spaced apart arc orifices disposed on the first arc;

a second arc selectively affixed to the first arc via a peg and a port, the second arc selectively affixed to the second swingarm via a peg and a port;

a plurality of vertically disposed spaced apart arc orifices disposed on the second arc;

a base insert selectively disposed between the first arc and the second arc;

at least one loop disposed on the base insert;

a center vertical selectively inserted into the first joint port and the second joint port, the first joint port, the second joint port, and the center vertical forming a pivot joint;

a plurality of spaced apart center vertical orifices disposed along the center vertical;

a pair of identical verticals comprising a first vertical and a second vertical, the first vertical selectively inserted into any one of the plurality of first arc arc orifices, the second vertical selectively inserted into any one of the plurality of second arc arc orifices;

at least one elastic cable having a pair of identical spaced apart removable handles comprising a first handle and a second handle, each cable selectively passed through one or more of the center vertical orifices, each cable further selectively passed through one or more of the vertical orifices of the verticals, each cable selectively passed through the at least one loop of the base insert.

8. The apparatus according to claim 7 wherein the base insert selectively disposed between the first arc and the second arc further comprises a peg and a port.

9. The apparatus according to claim 7 further comprising a pair of identical collars, each collar selectively positioned along the verticals, each collar having an open loop through which each elastic cable is selectively passed.

10. The apparatus according to claim 8 further comprising a pair of identical collars, each collar selectively positioned along the verticals, each collar having an open loop through which each elastic cable is selectively passed.

11. The apparatus according to claim 7 wherein the base extension further comprises a crossbar having a pair of identical crossbar loops, each crossbar loop in selective receipt of each elastic cable.

12. The apparatus according to claim 8 wherein the base extension further comprises a crossbar having a pair of identical crossbar loops, each crossbar loop in selective receipt of each elastic cable.

13. The apparatus according to claim 9 wherein the base extension further comprises a crossbar having a pair of identical crossbar loops, each crossbar loop in selective receipt of each elastic cable.

14. The apparatus according to claim 10 wherein the base extension further comprises a crossbar having a pair of identical crossbar loops, each crossbar loop in selective receipt of each elastic cable.

15. A modular exercise apparatus, comprising, in combination:

a semicircular multi-part base providing selective assembly, the base further comprising:

a first swingarm;

a first swingarm outer leg;

a first swingarm inner leg;

a first swingarm first joint port, the first joint port medially adjacent to the first swingarm inner leg;

a first swingarm peg laterally disposed perpendicularly to the first swingarm outer leg;

a second swingarm;

a second swingarm outer leg;

a second swingarm inner leg;

a second joint port disposed medially adjacent to the second swingarm inner leg;

a second swingarm peg laterally disposed perpendicularly to the second swingarm outer leg;

a first arc selectively affixed to the first swingarm, the first arc comprising:

a plurality of vertically disposed spaced apart arc orifices;

a horizontally disposed first arc port in selective receipt of the first swingarm peg;

a horizontally disposed first arc peg spaced apart from the first arc port;

a second arc selectively affixed to the second swingarm, the second arc comprising:

a plurality of vertically disposed spaced apart arc orifices;

a horizontally disposed second arc first port in selective receipt of the first arc peg;

a second arc second port spaced apart from the second arc first port, the second arc second port in selective receipt of the second swingarm peg;

a base insert selectively positioned between the first arc and the second arc, the base insert comprising a base insert port spaced apart from a base insert peg, the base insert port in selective receipt of the first arc peg, the base insert peg selectively inserted into the second arc first port, the base insert further comprising:

a base insert extension spaced apart from the base insert port and base insert peg;

a crossbar affixed perpendicularly through the base insert extension;

a pair of spaced apart right angles disposed on the crossbar, comprising a first right angle and a second right angle, each right angle having a crossbar loop comprised of a first crossbar loop and a second crossbar loop;

a center vertical selectively inserted into the first joint port and the second joint port, the first joint port, the second joint port, and the center vertical forming a pivot joint;

a plurality of spaced apart center vertical orifices disposed along the center vertical;

a semicircular sleeve selectively positioned along the center vertical, the sleeve partially comprising a pair of opposed notches comprised of a first notch and a second notch, the notches selectively positioned in alignment with one of the plurality of center vertical orifices;

a pair of identical verticals comprising a first vertical and a second vertical, the first vertical selectively inserted into any one of the plurality of first arc arc orifices, the second vertical selectively inserted into any one of the plurality of second arc arc orifices, each vertical further comprising:

a plurality of spaced apart horizontally disposed vertical orifices;

a pair of identical collars, each collar selectively and slideably fitted over one of the pair of identical verticals, each collar having a collar first side spaced apart from a collar second side, each collar further comprising:

a horizontally disposed collar orifice within each collar first side;

an open loop disposed on each collar second side;

at least two keepers, each keeper selectively inserted into one of the collar orifices and into one of the selected vertical orifices of one of the verticals;

a pair of identical rings, each ring selectively disposed on one of the open loops of one of the collars;

at least one elastic cable having a pair of identical spaced apart removable handles comprising a first handle and a second handle, each cable selectively passed through one or more of the center vertical orifices, each cable further selectively passed through one or more of the rings, each cable further selectively passed through one or more of the open loops of the collars, each cable selectively passed through one or more of the crossbar loops.

* * * * *